US010851983B2

(12) United States Patent
Feng et al.

(10) Patent No.: US 10,851,983 B2
(45) Date of Patent: Dec. 1, 2020

(54) ADAPTER, LIGHT SOURCE DEVICE AND ILLUMINATING DEVICE

(71) Applicant: OPPLE LIGHTING CO., LTD., Shanghai (CN)

(72) Inventors: Xuejun Feng, Shanghai (CN); Chengpei You, Shanghai (CN); Hongbo Wang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 197 days.

(21) Appl. No.: 16/193,573

(22) Filed: Nov. 16, 2018

(65) Prior Publication Data

US 2019/0086067 A1 Mar. 21, 2019

Related U.S. Application Data

(63) Continuation of application No. PCT/CN2017/084368, filed on May 15, 2017.

(30) Foreign Application Priority Data

May 20, 2016 (CN) ..... 2016 1 0343490

(51) Int. Cl.
*F21V 23/06* (2006.01)
*H01R 31/06* (2006.01)
(Continued)

(52) U.S. Cl.
CPC ..... *F21V 23/06* (2013.01); *F21V 23/001* (2013.01); *F21V 23/02* (2013.01); *F21V 23/04* (2013.01);
(Continued)

(58) Field of Classification Search
CPC ..... F21V 23/001; F21V 25/04; F21V 23/06; H01R 33/955; H01R 31/065; H01R 33/96; F21K 9/275; F21K 9/238
See application file for complete search history.

(56) References Cited

U.S. PATENT DOCUMENTS

2012/0307524 A1* 12/2012 Schapira ..... F21V 19/008 362/652
2015/0198318 A1* 7/2015 Lee ..... F21K 9/27 362/223

FOREIGN PATENT DOCUMENTS

CN 204083897 U 1/2015
CN 204114661 U 1/2015
(Continued)

OTHER PUBLICATIONS

International Search Report (including English translation) and Written Opinion issued in PCT/CN2017/084368, dated __, _ pages

*Primary Examiner* — Karabi Guharay
(74) *Attorney, Agent, or Firm* — Arch & Lake LLP

(57) ABSTRACT

An adapter, a light source device employing the same, and an illuminating device employing the same are provided. The adapter includes a main body, an ejector pin movably connected with the main body, and an operating member disposed between the ejector pin and the main body. The main body includes: a power supply mounting part, a light source mounting part, and a conducting wire extended from the power supply mounting part to the light source mounting part. The ejector pin is operationally moved to a blocking position for preventing the power supply mounting part from being matched with the power supply module and a release position for releasing the power supply mounting part to be matched with the power supply module. The operating member is operationally moved on the main body to an 'on' position and an 'off' position.

19 Claims, 9 Drawing Sheets

(51) Int. Cl.

| | |
|---|---|
| ***F21V 19/00*** | (2006.01) |
| ***H01R 33/94*** | (2006.01) |
| ***F21V 25/04*** | (2006.01) |
| ***H01R 33/955*** | (2006.01) |
| ***F21V 23/00*** | (2015.01) |
| ***F21V 23/02*** | (2006.01) |
| ***F21V 23/04*** | (2006.01) |
| ***H01R 33/96*** | (2006.01) |
| ***H01R 33/97*** | (2006.01) |
| *F21Y 103/00* | (2016.01) |
| *H01R 33/06* | (2006.01) |

(52) U.S. Cl.

CPC ..... *F21V 25/04* (2013.01); *H01R 33/94* (2013.01); *H01R 33/955* (2013.01); *H01R 33/96* (2013.01); *H01R 33/97* (2013.01); *F21Y 2103/00* (2013.01); *H01R 33/06* (2013.01)

(56) References Cited

FOREIGN PATENT DOCUMENTS

| | | |
|---|---|---|
| CN | 105180104 | 12/2015 |
| CN | 2015174035 U | 4/2016 |
| CN | 205752893 U | 11/2016 |

* cited by examiner

ADAPTER, LIGHT SOURCE DEVICE AND ILLUMINATING DEVICE

CROSS-REFERENCE TO RELATED APPLICATIONS

This application is based upon and claims the priority of PCT patent application No. PCT/CN2017/084368 filed on May 15, 2017 which claims the priority of Chinese Patent Application No. 201610343490.4 filed on May 20, 2016, the entire contents of which are hereby incorporated by reference herein.

TECHNICAL FIELD

The present disclosure relates to the technical field of illumination, in particular to an adapter, a light source device and an illuminating device.

BACKGROUND

Currently, an illuminating device usually emits illuminating light to an irradiated object through a power-driven light-emitting apparatus, so as to illuminate the irradiated object. With the rapid development of lighting technology, the illuminating devices are more and more popular. How to improve the safety of the illuminating device is also concerned in the industry.

The conventional illuminating device generally comprises a light-emitting apparatus for emitting illuminating light, a power supply module used for supplying power, and an adapter used for matching the light-emitting apparatus with the power supply module. The adapter usually includes a conducting wire connected with the light-emitting apparatus and a conductive terminal electrically connected with the conducting wire and used for being matched with the power supply module. After the light-emitting apparatus, the adapter and the power supply module are matched with each other, the power outputted by the power supply module sequentially runs through the conductive terminal and the conducting wire and arrives at the light-emitting apparatus, so that the light-emitting apparatus can emit the illuminating light.

The conventional illuminating device is lack of a safety protection device, and the user can start the illuminating device by the direct electrical connection between the conductive terminal and the power supply module. If the conductive terminal and the power supply module are electrically connected due to a misoperation of a user, the user will easily get an electric shock, so the conventional illuminating device has great potential safety problem.

SUMMARY

An objective of examples of the present disclosure is to provide an adapter, a light source device and an illuminating device, which are used for solving the potential safety problem in the conventional illuminating device.

In a first aspect, the present disclosure provides an adapter, which is used for electrically connecting a power supply module and a light-emitting apparatus. The adapter may include: a main body including: an outer wall forming an inner cavity; a power supply mounting part disposed on the outer wall and used for being matched with the power supply module; a light source mounting part disposed on the outer wall, arranged oppositely to the power supply mounting part, and used for being matched with the light-emitting apparatus; and a conducting wire disposed in the inner cavity, and configured to be capable of being turned on and turn off, and used for transmitting electrical power outputted by the power supply module to the light-emitting apparatus when the power supply mounting part is matched with the power supply module and the light source mounting part is matched with the light-emitting apparatus; an ejector pin movably connected to the main body, in which the ejector pin is operationally moved to a blocking position for preventing the power supply mounting part from being matched with the power supply module and a release position for releasing the power supply mounting part to be matched with the power supply module; and an operating member movably connected with the main body and the ejector pin, in which the operating member is operationally moved on the main body to an 'on' position and an 'off' position; when the power supply mounting part is matched with the power supply module, the ejector pin is moved to the release position under the resisting force of the power supply module and is maintained at the release position, and the operating member is moved to the 'on' position to turn on the conducting wire; and when the power supply mounting part is separated from the power supply module, the ejector pin is moved from the release position to the blocking position, and meanwhile, drives the operating member to move from the 'on' position to the 'off' position to disconnect the conducting wire.

In a second aspect, the present disclosure provides a light source device, which may include: a light-emitting apparatus; and the adapter according to any one of the preceding disclosures, in which the light source mounting part in the adapter is matched with the light-emitting apparatus, so that the conducting wire can be electrically connected with the light-emitting apparatus.

In a third aspect, the present disclosure provides an illuminating device, which may include: a light-emitting apparatus; a power supply module; and the adapter according to any one of the preceding disclosures, in which the light source mounting part in the adapter is matched with the light-emitting apparatus, and the power supply mounting part in the adapter is matched with the power supply module, so that both the light-emitting apparatus and the power supply module can be electrically connected with the conducting wire.

The foregoing is only the brief description of the technical proposals of the present disclosure. For more clearly understanding the technical proposals of the present disclosure which can be implemented, and for more apparently and easily understanding the above and other objectives, characteristics and advantages of the present disclosure, specific examples of the present disclosure are given below.

BRIEF DESCRIPTION OF THE DRAWINGS

For more clearly understanding the technical proposals in the examples of the present disclosure or the prior art, simple description will be given below to the accompanying drawings required to be used in the description of the examples or the prior art. Apparently, the accompanying drawings described below are only some examples recorded in the present disclosure. Other accompanying drawings may also be obtained by one of ordinary skill in the art without creative efforts on the basis of the accompanying drawings.

DETAILED DESCRIPTION

Examples of the present disclosure provide an adapter, a light source device and an illuminating device, which are used for solving the potential safety problem in the illuminating device in the prior art.

For better understanding of the technical proposals in the present disclosure, technical proposals of the examples will be described in a clearly and fully understandable way in connection with the drawings in the examples of the disclosure. It is apparent that the described examples are just a part but not all of the examples of the disclosure. Based on the described examples herein, one of ordinary skill in the art can obtain other example(s), without any creative work, which shall be within the scope of the disclosure.

Figure 1:
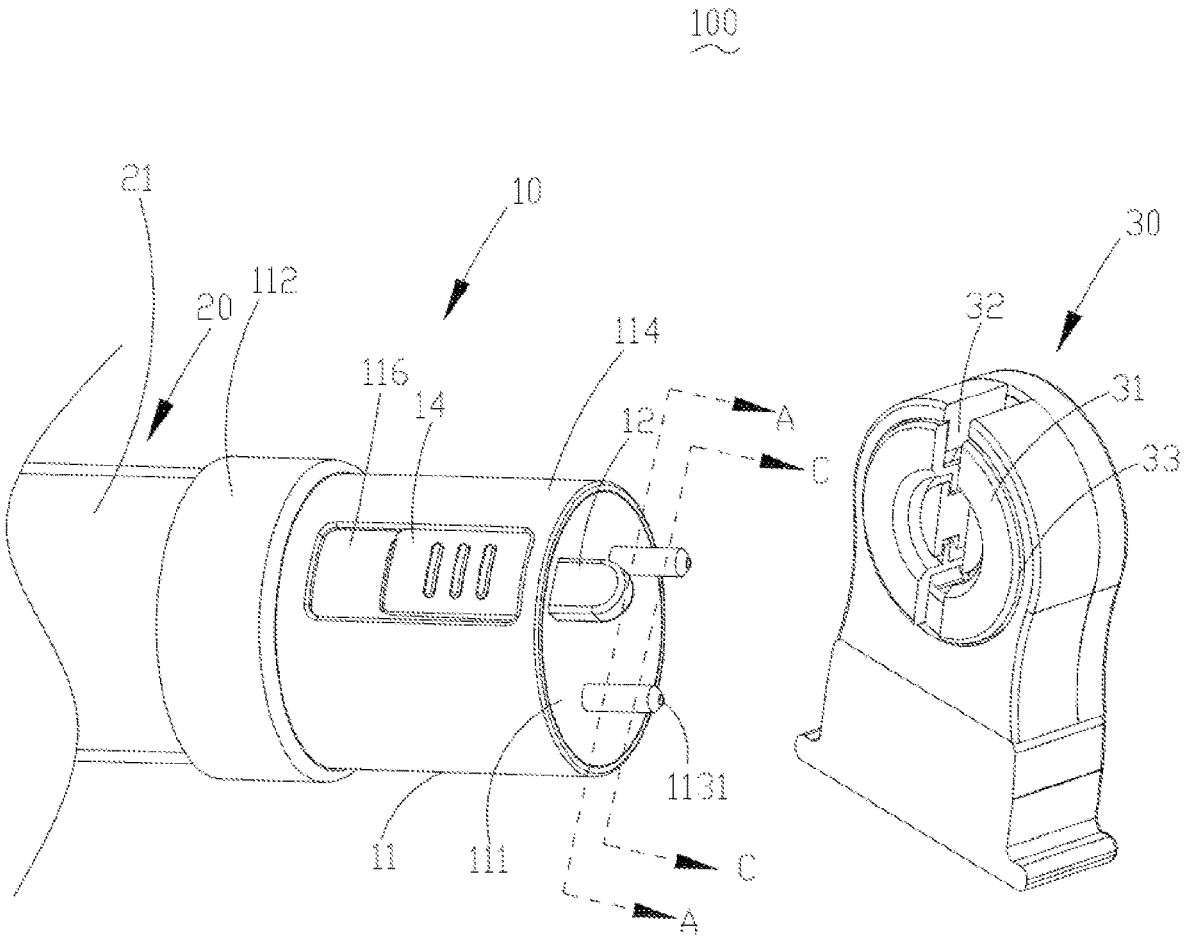
FIG. 1 is a partial exploded view of an illuminating device provided by an example of the present disclosure, in which an adapter is matched with a light-emitting apparatus but separated from a power supply module; an operating member is at the 'off' position; and an ejector pin is at the blocking position.
Figure 2:
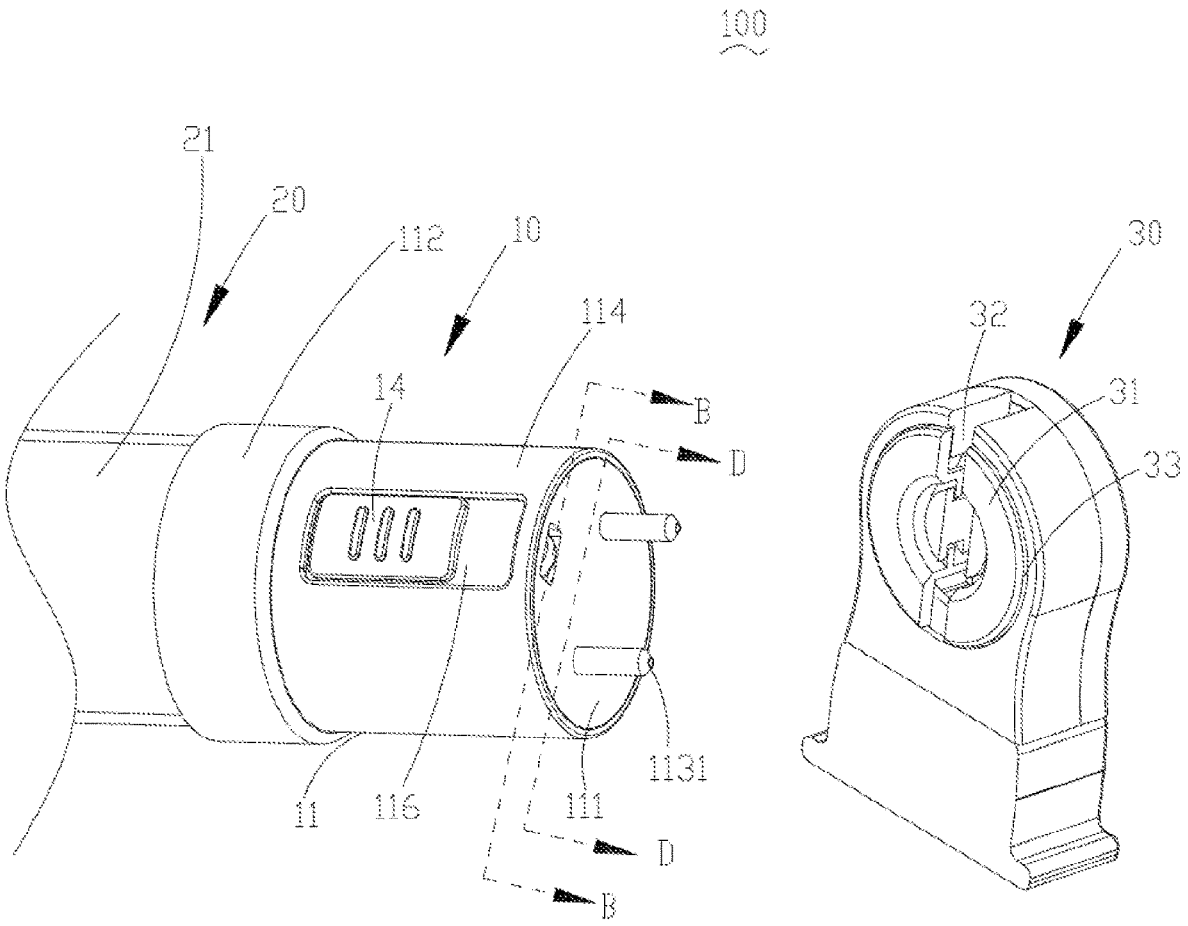
FIG. 2 is a partial exploded view of an illuminating device provided by an example of the present disclosure, in which an adapter is matched with a light-emitting apparatus but separated from a power supply module, an operating member is at the 'on' position, and an ejector pin is at the release position.
Figure 3:
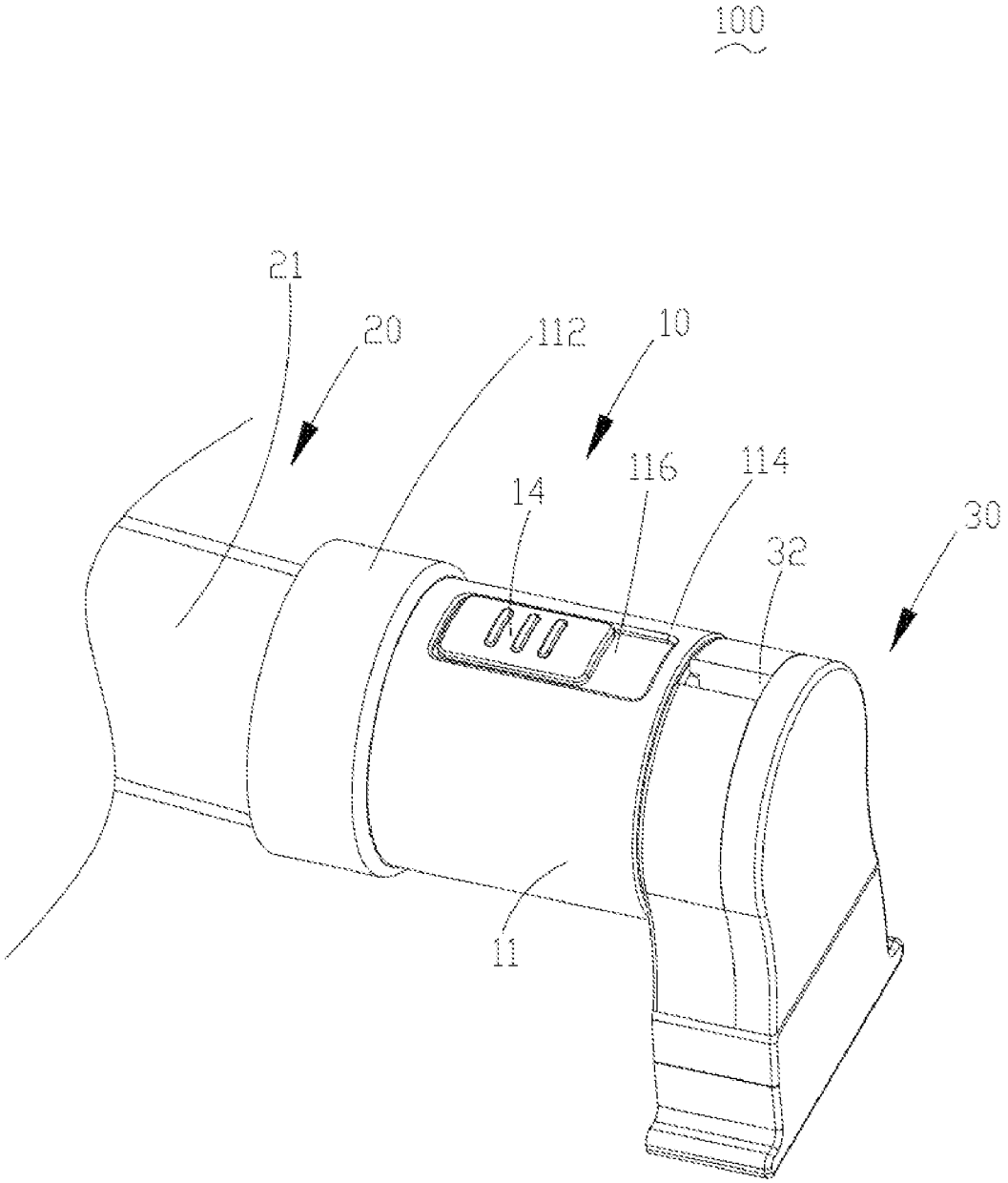
FIG. 3 is an assembly stereo diagram of an illuminating device provided by an example of the present disclosure, in which an adapter is matched with both a light-emitting apparatus and a power supply module.

As shown in FIGS. 1 to 3, an illuminating device 100 comprises an adapter 10, a light-emitting apparatus 20 and a power supply module 30. The light-emitting apparatus 20 and the adapter 10 may be combined into a light source device. For instance, the light-emitting apparatus 20 and the adapter 10 are integrally arranged and as a light source device which can be sold and used independently. When there is a lighting demand, a user may directly match the light source device with the power supply module 30, so that the power supply module 30 can supply power for the light-emitting apparatus 20, and the light-emitting apparatus 20 can emit illuminating light to an irradiated object, so as to illuminate the irradiated object.

The light-emitting apparatus 20 includes an optical element 21, light sources (not shown in the figure) and a drive component (not shown in the figure) used for adjusting the current provided for the light sources. The light sources are electrically connected with the drive component, and subsequently may be electrically connected with the adapter 10.

Each of the light sources may adopt various types, such as a light-emitting diode (LED) light source and a TL light source. The drive component may adopt an integrated circuit board type. The optical element 21 covers the light sources and the drive component and is used for protecting the light sources and the drive component from external damage and refracting the illuminating light emitted by the light sources onto an object. The optical element 21 may adopt a lens form in which the illuminating light emitted by the light sources can penetrate directly, or may adopt a mixed light shield form in which the illuminating light emitted by the light sources can be uniformly adjusted. No matter the lens form or the mixed light shield form is used, the shape of the optical element 21 may be preset according to the lighting environment, for instance, it may be set to be a long straight tube. The number of the optical elements 21 may be consistent or inconsistent with that of the light sources. For instance, one light source is matched with one optical element 21, or a plurality of light sources are matched with a single optical element 21.

The power supply module 30 may adopt a DC supply or an AC supply. The power supply module 30 may be fixed to the wall, the ceiling, the floor or other areas, and corresponding illuminating device 100 may be a ceiling lamp, a wall lamp, a tube, or the like. The power supply module 30 may also be set to be movable, and the illuminating device 100 may be a mobile desk lamp, a floor lamp, or the like.

In the example of the present disclosure, the power supply module 30 includes an annular barrier wall 31 and an ejector pin groove 32 and a terminal connecting part 33 which are covered by the annular barrier wall 31. The annular barrier wall 31 may rotate on the power supply module 30, so as to expose and cover the ejector pin groove 32 and the terminal connecting part 33. In the moving process of the annular barrier wall 31, the annular barrier wall 31 may be moved to a position at which the ejector pin groove 32 is exposed and the terminal connecting part 33 is covered, or may be moved to a position at which the ejector pin cover 32 is covered and the terminal connecting part 33 is exposed.

The annular barrier wall 31 may be made from electric insulating material and is used for preventing the user from accidentally touching the terminal connecting part 33 to cause an electric shock accident. The terminal connecting part 33 may be set to be two separate semi-rings which are respectively act as positive and negative electrodes of the power supply module 30.

In the example of the present disclosure, the adapter 10 comprises a main body 11, an ejector pin 12 and an operating member 14. The main body 11 may be made from hard material, such as plastics and metal, as long as the structural stability of the main body 11 can be guaranteed.

Figure 4:
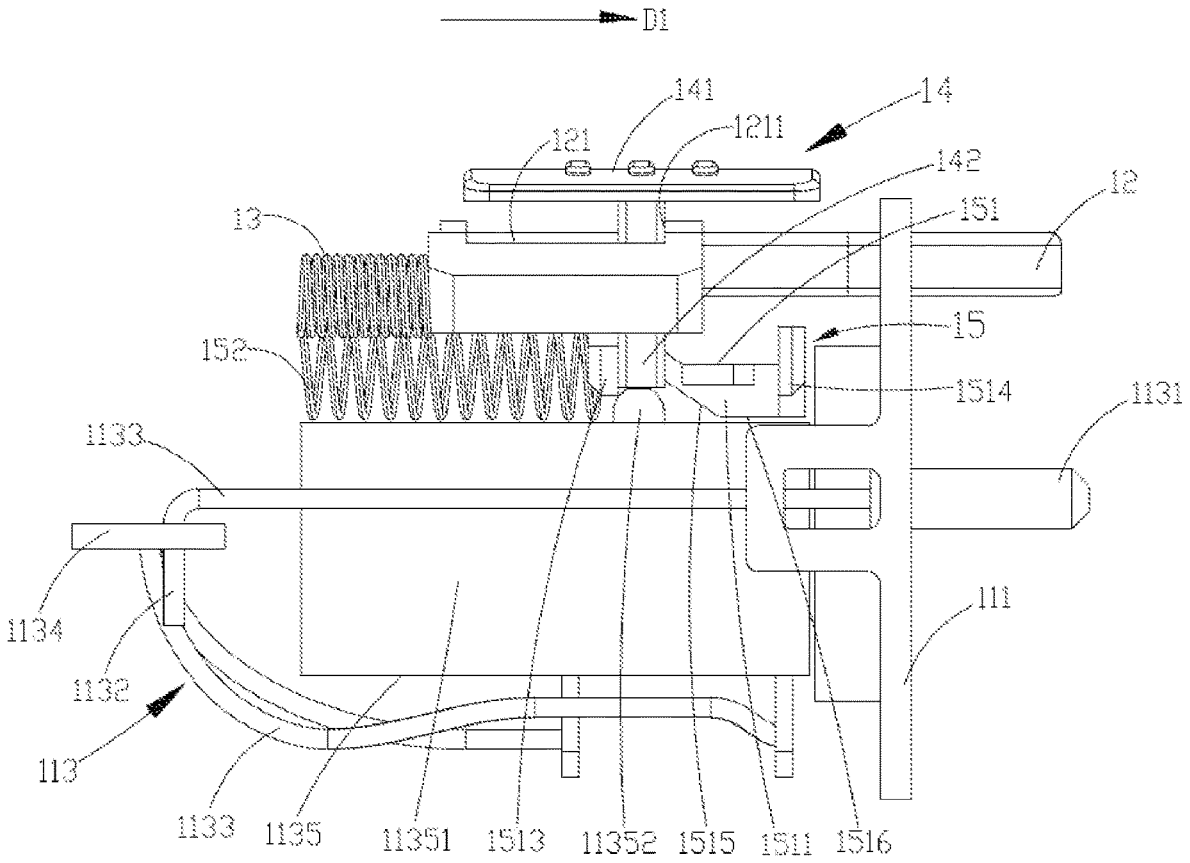
FIG. 4 is a side view of the adapter in the illuminating device as shown in FIG. 1, in which a main body of the adapter is hidden.
Figure 5:
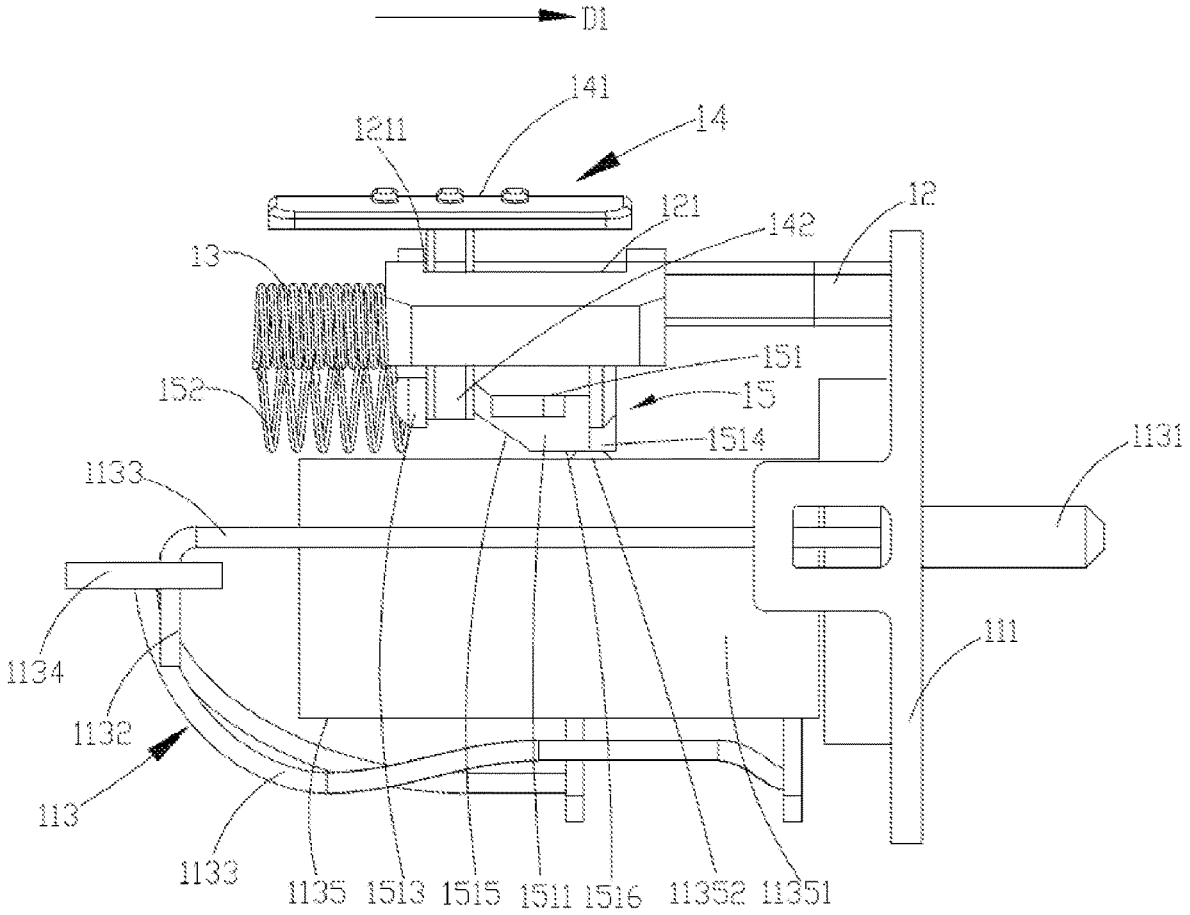
FIG. 5 is a side view of the adapter in the illuminating device as shown in FIG. 2, in which a main body of the adapter is hidden.

With reference to FIGS. 4 and 5, the main body 11 includes a power supply mounting part 111, a light source mounting part 112 and a conducting wire 113. The relative positions of the power supply mounting part 111 and the light source mounting part 112 may be set according to the position of the adapter 10 in the illuminating device 100, for instance, may be set to be side-by-side type, reverse type, vertical type, or the like. The power supply mounting part 111 is used for being matched with the power supply module 30. The power supply module 30 and the power supply mounting part 111 may be relatively fixed by various means, such as a snap fit structure, threads and screws. The light source mounting part 112 is used for being matched with the light-emitting apparatus 20. The light-emitting apparatus 20 and the light source mounting part 112 may also be relatively fixed by various means, such as a snap fit structure, threads and screws.

The main body 11 has a longitudinal direction D1. The main body 11 may be set to be a long straight tube extended along the longitudinal direction D1. The power supply mounting part 111 and the light source mounting part 112 are respectively disposed at two opposite ends of the long straight tube main body 11 along the longitudinal direction D1.

Figure 6:
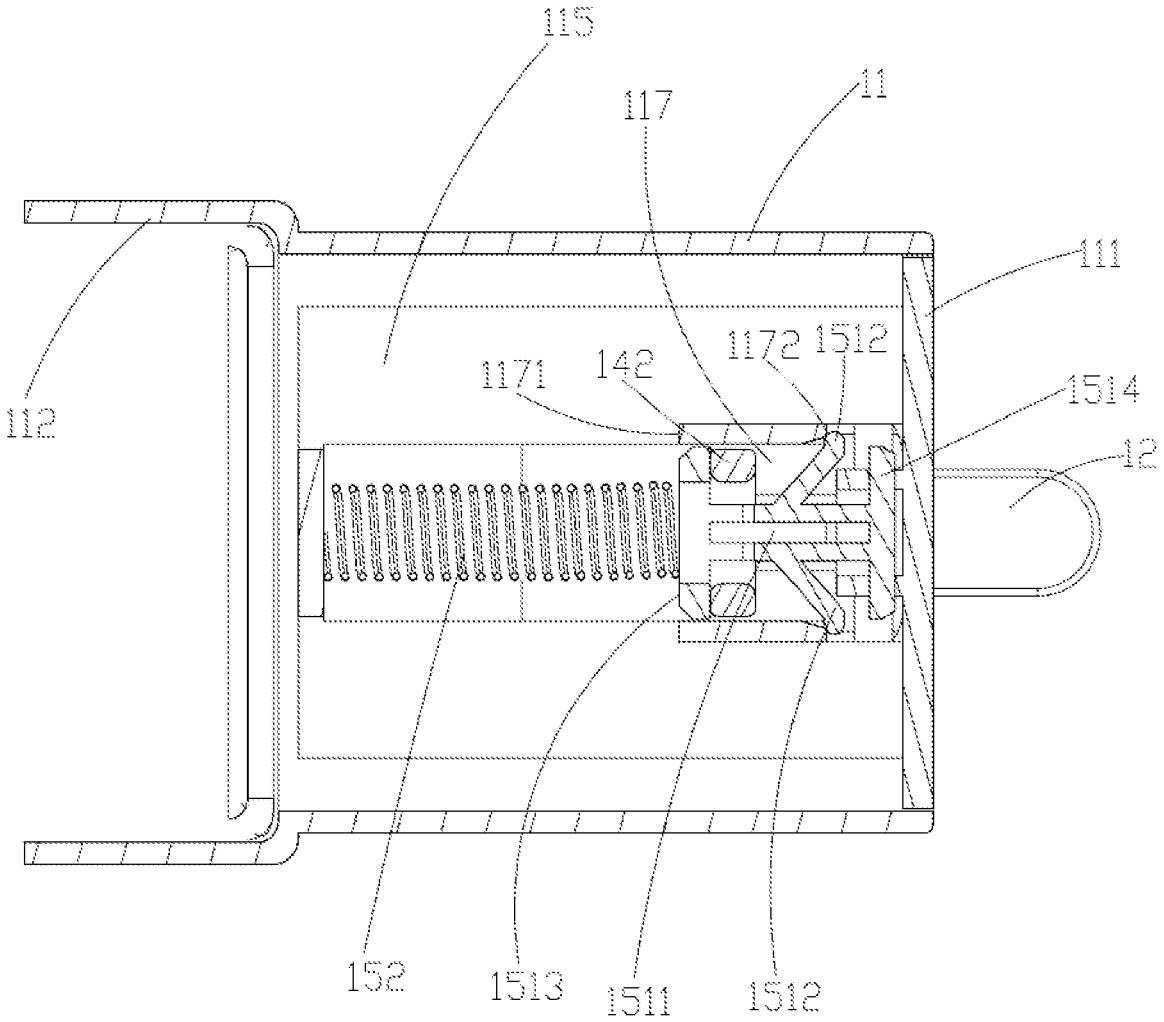
FIG. 6 is a sectional view of the adapter in the illuminating device as shown in FIG. 1 in the A-A direction.
Figure 7:
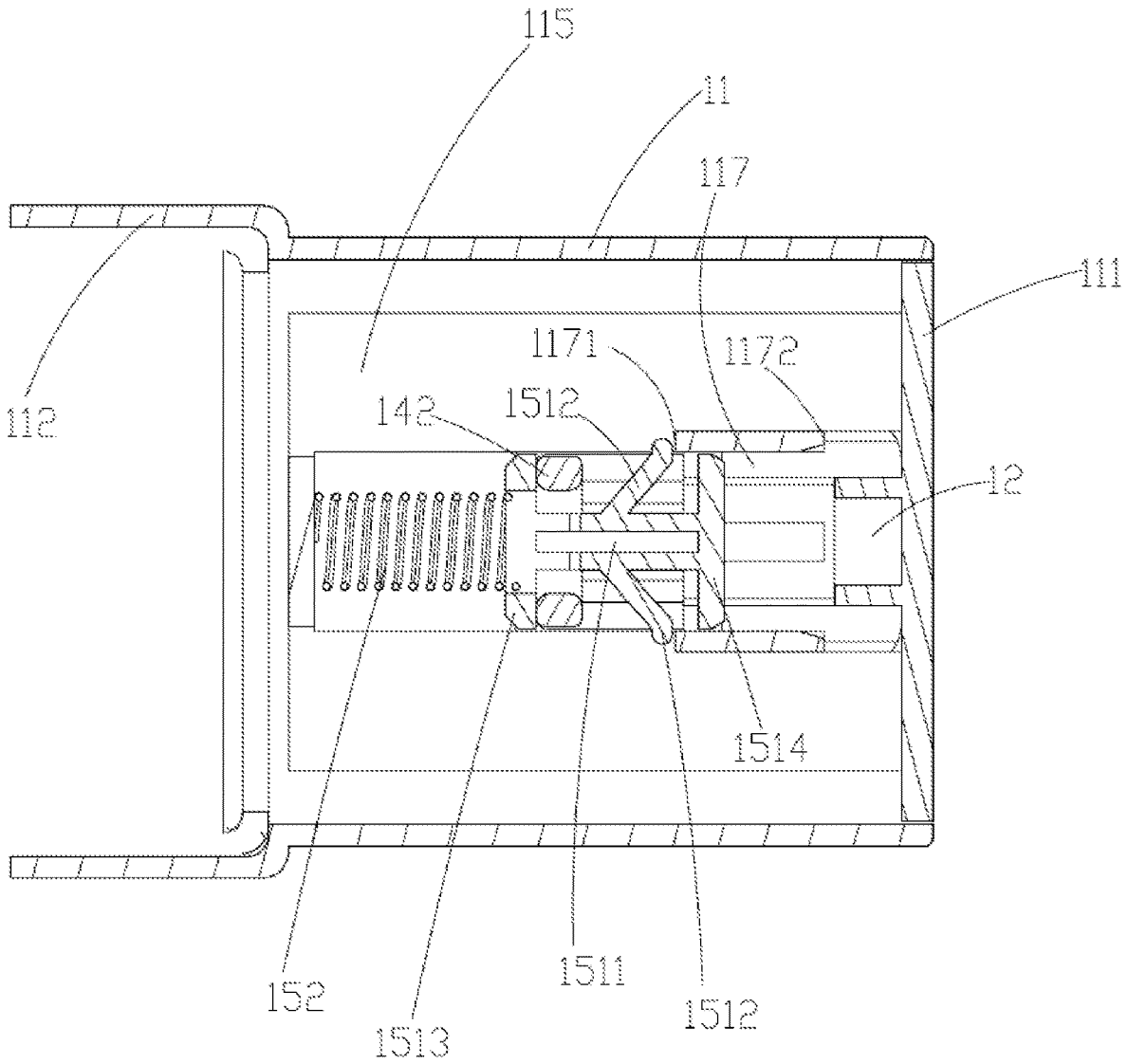
FIG. 7 is a sectional view of the adapter in the illuminating device as shown in FIG. 2 in the B-B direction.

In the example of the present disclosure, the main body 11 further includes an outer wall 114 and an inner cavity 115 surrounded by the outer wall 114; both the power supply mounting part 111 and the light source mounting part 112 are disposed on the outer wall 114; and the conducting wire 113 is accommodated into the inner cavity 115, as shown in FIGS. 6 and 7.

In actual application, the power supply mounting part 111 may be set to be a convex end face; correspondingly, an area on the power supply module 30, matched with the power supply mounting part 111, is set to be an opening; and the power supply mounting part 111 may be inserted into the opening area in the power supply module 30 at first, and then the power supply mounting part and the power supply module are tightly connected by the foregoing fixing means, such as a snap fit structure, or threads. In the example of the present disclosure, the power supply mounting part 111 may be matched with the power supply module 30 along the longitudinal direction D1 of the main body 11 by adjusting the shape of the power supply mounting part 111.

As described above, the light source mounting part 112 may be set to be a concave opening; and the light-emitting apparatus 20 may be inserted into the opening light source mounting part 112 at first, and then the light-emitting apparatus and the light source mounting part are tightly connected by the above fixing means, such as a snap fit structure, or screws, or the light-emitting apparatus 20 and the main body 11 may be directly integrally arranged.

The conducting wire 113 includes a first conductive terminal 1131 used for being electrically connected with the power supply module 30, a second conductive terminal 1132 used for being electrically connected with the light-emitting apparatus 20, a leading wire 1133 connected in series with the first conductive terminal 1131 and the second conductive terminal 1132, and a control module 1134 and an 'on-off' switch 1135 connected in series to the leading wire 1133.

In actual application, the leading wire 1133 may be made from the conventional enameled copper wire or enameled routing wire, and may also be formed by a hard metallic conductor, so as to realize the basic requirement of current conduction. For instance, the leading wire 1133 for connecting the 'on-off' switch 1135 and the control module 1134 may adopt an enameled copper wire, and the leading wire 1133 for connecting the control module 1134 and the first conductive terminal 1131 may adopt a hard metallic conductor. The leading wires 1133 may be electrically connected with the first conductive terminal 1131, the second conductive terminal 1132, the 'on-off' switch 1135 and the control module 1134 by fixed connection processes, such as welding, pressure welding, and insulation piercing, or adapter interface modes, such as FFC, and FPC.

In the example of the present disclosure, the control module 1134 is disposed at the position of the light source mounting part 112, and the second conductive terminal 1132 used for being matched with the light-emitting apparatus 20 may be directly disposed on the control module 1134.

The control module 1134 may adopt an integrated circuit board and may include the conventional functional modules, such as a current detection module, a voltage detection module and a control chip. A plurality of protective functions and the driving function of the light-emitting apparatus 20 may be integrated into the control chip. For instance, the current in the conducting wire 113 may be acquired from the current detection module through the control chip. When the current is overlarge, the conducting wire 113 is disconnected, and the overcurrent protection of the light-emitting apparatus 20 is realized. For instance, the voltage applied to the first conductive terminal 1131 may be acquired from the voltage detection module through the control chip. When the voltage is too low, the conducting wire 113 is disconnected to realize the over-discharge protection in the process of adopting a DC battery pack as the power supply module 30. For instance, the current in the conducting wire 113 may be adjusted through the control chip in such a way that the light-emitting apparatus 20 can work under rated operating current.

The 'on-off' switch 1135 may include a switch base 11351 connected in series to the conducting wire 113 and a switch button 11352 connected with the switch base 11351. The switch base 11351 may be switched on and switched off by pressing the switch button 11352, so as to realize the conduction and disconnection of the conducting wire 113. The switch base 11351 may be a base of a common microswitch, so the switch button 11352 may be a button of the microswitch.

The state of the 'on-off' switch 1135 is adjusted to realize the electrical conduction between the first conductive terminal 1131 and the second conductive terminal 1132 when the 'on-off' switch 1135 is in the 'on' state, or vice versa, to realize the electrical isolation between the first conductive terminal 1131 and the second conductive terminal 1132 when the 'on-off' switch 1135 is in the 'off' state.

When the power supply module 30 is matched with the power supply mounting part 111, and the light-emitting apparatus 20 is matched with the light source mounting part 112, or the light-emitting apparatus 20 and the light source mounting part 112 are directly and integrally arranged, the power supply module 30 is electrically connected with the first conductive terminal 1131 in the conducting wire 113, and the light-emitting apparatus 20 is electrically connected with the second conductive terminal 1132 in the conducting wire 113, so that the power outputted by the power supply module 30 can be transmitted to the light-emitting apparatus 20 through the adapter 10.

With reference to FIGS. 6 and 7, the ejector pin 12 may be movably connected with the main body 11 and used for implementing safety protection on the mounting process of the main body 11 and the power supply module 30, so as to meet the safety requirements.

The ejector pin 12 is operationally moved to a blocking position and a release position. The ejector pin 12 prevents the power supply mounting part 111 from being matched with the power supply module 30 when it is disposed at the blocking position, and releases the power supply mounting part 111 to be matched with the power supply module 30 when it is disposed at the release position.

It is noted that "the power supply mounting part 111 is matched with the power supply module 30" described in this text is used to refer to the state that the power supply mounting part 111 and the power supply module 30 are mechanically connected and the conducting wire 113 and the power supply module 30 are electrically connected, excluding the state that the power supply mounting part 111 and the power supply module 30 are mechanically connected but the conducting wire 113 and the power supply module 30 are not electrically connected.

For instance, when the light-emitting apparatus 20 and the adapter 10 are integrally arranged to form a light source device capable of being used independently, due to the arrangement of the ejector pin 12, when there is no need for mounting the light source device on the power supply module 30, the user can move the ejector pin 12 to the blocking position, so that the adapter 10 cannot be matched with the power supply module 30, which can avoid the user from accidently matching the adapter 10 in the light source device with the power supply module 30 without safety precautions to cause electric shock, ensuring the safety of the user, and ensuring that the illuminating device 100 can meet the safety requirements. Conversely, when there is need for mounting the light source device on the power supply module 30, the user may move the ejector pin 12 to the release position, so that the adapter 10 can be matched with the power supply module, and hence the illuminating device 100 can work normally.

In actual application, the ejector pin 12 may move along the longitudinal direction D1 of the main body 11; and when the power supply mounting part 111 is matched with the power supply module 30, the ejector pin 12 originally disposed at the blocking position may be pushed towards the release position through the power supply module 30, and the user only needs one step to complete the position adjustment of the ejector pin 12 and the subsequent matching of the power supply module 30 and the adapter 10, so the user experience can be improved.

Before the power supply mounting part 111 is matched with the power supply module 30, the annular barrier wall 31 in the power supply module 30 is moved to the position at which the ejector pin groove 32 is exposed and the terminal connecting part 33 is covered. When the power supply mounting part 111 is mounted on the power supply module 30, the ejector pin 12 disposed at the blocking position enters the ejector pin groove 32, due to the covering by the annular barrier wall 31, the first conductive terminal 1131 cannot be matched with the terminal connecting part 33, and the adapter 10 is needed to rotate in the power supply module 30 around the longitudinal direction D1 thereof; as the tail end of the ejector pin 12 is set to be rounding-off, the ejector pin 12 is moved towards the release position and disengaged from the ejector pin groove 32; and subsequently, when the ejector pin 12 is moved to be parallel and level to the annular barrier wall 31, the annular barrier wall 31 is driven to rotate in such a way that the terminal connecting part 33 is exposed, and the first conductive terminal 1131 may be matched with the terminal connecting part 33.

Of course, in other examples of the present disclosure, the first conductive terminal 1131 may also be matched with the terminal connecting part 33 by directly pushing the ejector pin 12 to move towards the release position along the longitudinal direction D1, which are techniques well-known to one of ordinary skill in the art. No further description will be given here.

In the example of the present disclosure, the adapter 10 further comprises a first elastic element 13 disposed between the main body 11 and the ejector pin 12. The first elastic element 13 is used for providing the ejector pin 12 with an acting force for moving towards the blocking position when the ejector pin 12 is at the release position. Due to the provision of the first elastic element 13, the ejector pin 12 always has the tendency of moving towards the blocking position. When the adapter 10 is separated from the power supply module 30, the ejector pin 12 will be automatically restored to the blocking position.

The operating member 14 is disposed on the outer wall 114 and is operationally moved on the outer wall 114. The operating member 14 may be moved to the 'on' position and the 'off' position. When the power supply mounting part 111 is matched with the power supply module 30, the ejector pin 12 is moved to the release position, under the action of the resisting force of the power supply module 30, and is maintained at the release position, and the conducting wire 113 is turned on when the operating member 14 is moved to the 'on' position. When the power supply mounting part 111 is separated from the power supply module 30, the pressurized first elastic element 13 rebounds the ejector pin 12 from the release position to the blocking position. In this process, the operating member 14 is driven to move from the 'on' position to the 'off' position.

Figure 8:
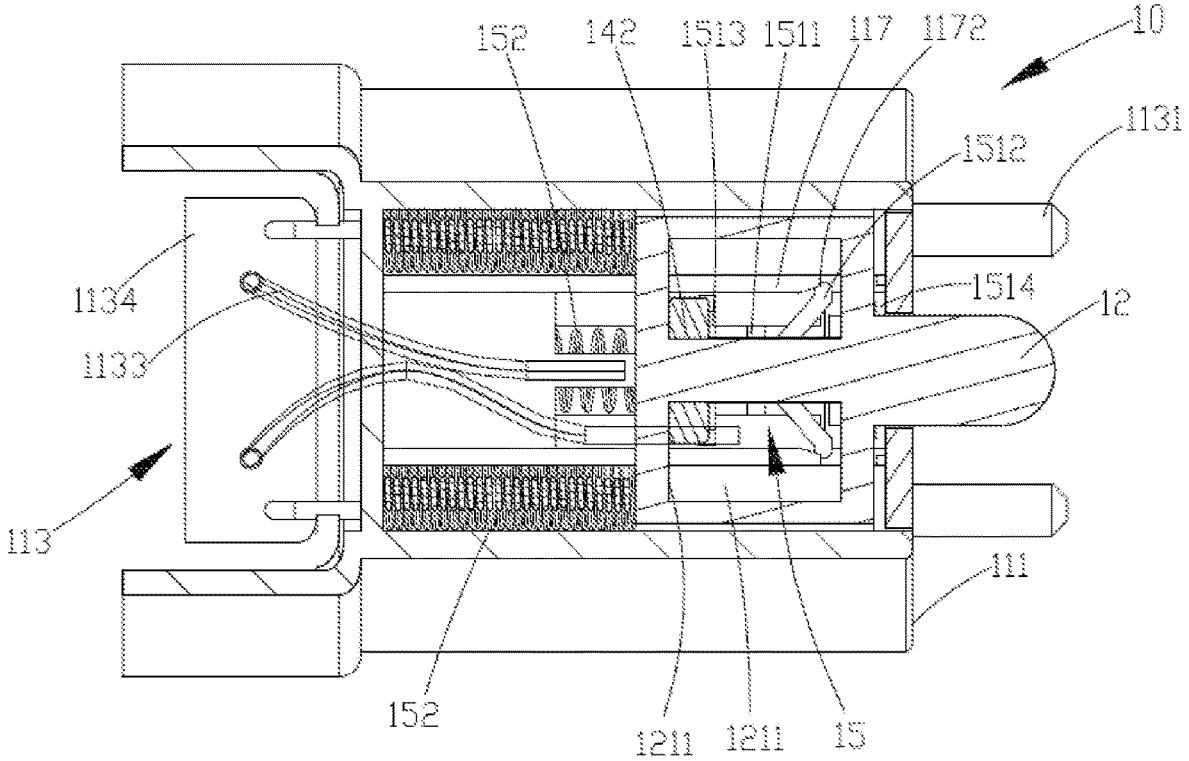
FIG. 8 is a sectional view of the adapter in the illuminating device as shown in FIG. 1 in the C-C direction.
Figure 9:
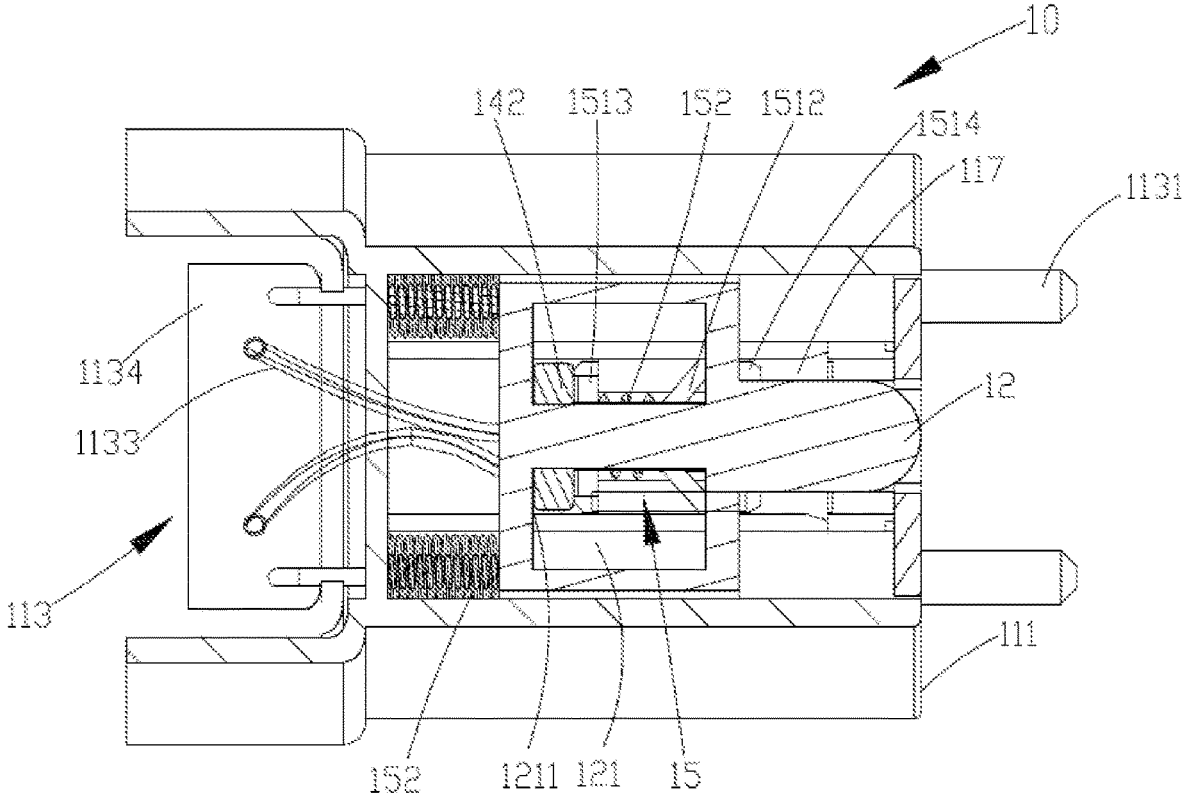
FIG. 9 is a sectional view of the adapter in the illuminating device as shown in FIG. 2 in the D-D direction.

With reference to FIGS. 8 and 9, the ejector pin 12 includes an operating member accommodating cavity 11; the operating member 14 includes a slightly cambered toggle part 141 and an extension part 142 formed by being extended from the toggle part; and a surface of the toggle part 141 is set to be rough, so as to facilitate the toggling by fingers of the user. The extension direction of the extension part 142 is extended from the outer wall 114 of the main body 11 to the inner cavity 115, until the extension part 142 is extended into the operating member accommodating cavity 121; and with the movement of the operating member 14, the extension part 142 will interfere with the barrier wall 1211 on the periphery of the operating member accommodating cavity 121. When the operating member 14 is at the 'on' position, the extension part 142 of the operating member 14 interferes with the barrier wall 1211 of the ejector pin 12, and the ejector pin 12 is locked to the release position; and at this point, the operating member 14 is locked to the inner cavity 115 of the main body 11. When the operating member 14 is at the 'off' position, the extension part 142 of the operating member 14 is moved away from the barrier wall 1211, and at this point, the operating member 14 is also unlocked from the inner cavity 115 of the main body 11.

In actual application, the main body 11 further includes a sliding chute 116 disposed on the outer wall 114; the operating member 14 is moved in the sliding chute 116 so as to switch between the 'on' position and the 'off' position; and the operating member 14 with different movement paths may be obtained according to the sliding chute 116 with different layouts. For instance, the sliding chute 116 may be extended along the longitudinal direction D1 of the main body 11, and the operating member 14 can move along the D1 direction. When the user grips the adapter 10 to be matched with the power supply module 30, the user may use the thumb to directly toggle the operating member 14 along the bending direction of the thumb, so the operation of the operating member 14 can be more ergonomic, and hence the user experience can be improved.

Of course, the operating member 14 may not move along the D1 direction, for instance, may perform spiral movement or rotation on the main body 11; or the operating member 14 may even be a push button, or the like. No further description will be given here.

When the operating member 14 moves between the 'on' position and the 'off' position, the operating member 14 will also contact the switch button 11352 of the 'on-off' switch 1135 in the conducting wire 113, so as to push and release the switch button 11352, namely the 'on-off' switch 1135 is pushed and released so as to be switched on and off, and then the conducting wire 113 is turned on and off. Specifically, when the operating member 14 is at the 'on' position, the extension part 142 of the operating member 14 is moved to the top of the switch button 11352 and the switch button 11352 is pressed towards the switch base 11351, so that the 'on-off' switch 1135 can be switched on. Conversely, when the operating member 14 is at the 'off' position, the extension part 142 of the operating member 14 is separated from the top of the switch button 11352, and the switch button 11352 will also be ejected and reset, so that the 'on-off' switch 1135 can be switched off.

In the example of the present disclosure, the main body 11 includes a locking slot 117 disposed in the inner cavity 115. The locking slot 117 may also be set to be extended along the longitudinal direction D1 of the main body 11. The locking slot 117 includes a head end 1171 and a tail end 1172 which are opposite to each other.

The adapter 10 further comprises a locking mechanism 15. The locking mechanism 15 includes a locking member 151 connected with the operating member 14 and disposed in the locking slot 117. The locking member 151 may be driven by the operating member 14 to move in the locking slot 117 and may be respectively locked to the head end 1171 and the tail end 1172. The difference is that: when the locking member 151 is locked to the head end 1171, it locks the operating member 14 to the 'on' position; and when the locking member 151 is locked to the tail end 1172, it locks the operating member 14 to the 'off' position, so as to avoid the user from accidently matching the adapter 10 with the power supply module 30 to cause electric shock.

The locking member 151 includes an intermediate part 1511 and arm parts 1512 respectively disposed on two sides of the intermediate part 1511 and intersected with the intermediate part 1511. The intermediate part 1511 is extended in the same direction as the locking slot 117. The two arm parts 1512 are roughly linear and are symmetrically distributed on the two sides of the intermediate part 1511, so an arrowhead-like locking member 151 is obtained. The arm parts 1512 are elastically connected with the intermediate part 1511 and operationally folded and expanded relative to the intermediate part 1511. Moreover, in normal state, the spacing between tail ends of the two arm parts 1512 exceeds the width of the locking slot 117. The locking member 151 abuts against the head end 1171 and the tail end 1172 of the locking slot 117 through the two arm parts 1512, so that the locking member 151 can be retained to the head end 1171 and the tail end 1172 of the locking slot 117.

The locking ember 151 further includes a limit part 1513 intersected with the intermediate part 1511. The limit part 1513 is disposed on an end portion of the intermediate part 1511 near the head end 1171 of the locking slot. The extension part 142 of the operating member 14 is also extended to a position between the limit part 1513 and the arm parts 1512. In the moving process of the operating member 14, the extension part 142 optionally abuts against the limit part 1513 or abuts against the arm parts 1512.

The locking member 151 further includes a guide part 1514 intersected with the intermediate part 1511. The guide part 1514 is disposed on an end portion of the intermediate part 1511 near the tail end 1172 of the locking slot, so the guide part 1514 and the limit part 1513 are respectively disposed on two sides of the arm parts 1512. The width of the guide part 1514 is approximate to the width of the locking slot 117. The guide part 1514 may be disposed in the locking slot 117 and fit with the locking slot 117, so that the locking member 115 can move along with the locking slot 117. In the example of the present disclosure, both the limit part 1513 and the guide part 1514 are set to be linear, and are parallel to each other and perpendicular to the intermediate part 1511.

The locking mechanism 15 further includes a second elastic element 152 disposed between the locking member 151 and the main body 11. The second elastic element 152 provides the locking member 151 with an acting force for moving towards the tail end 1172 of the locking slot. In the example of the present disclosure, the second elastic element 152 is a spring disposed between the limit part 1513 and the main body 11, and it is always in the compressive state, so as to push the locking member 151 towards the tail end 1172 of the locking slot.

The locking principle of the locking mechanism 15 is described in detail with reference to the structural definition of the locking mechanism 15 in the following description.

In actual application, the ejector pin 12 is always maintained at the blocking position under the action of the first elastic element 13. At this point, the two arm parts 1512 of the locking member 151 abut against the tail end 1172 of the locking slot 117 under the action of its own elastic restoring force, and it is difficult for the locking member 151 moving towards the head end 1171 of the locking slot 117. As the arm parts 1512 and the limit part 1513 are cooperated with each other to retain the position of the extension part 142, the operating member 14 is also retained at the 'off' position.

After the adapter 10 is mounted on the power supply module 30, the ejector pin 12 is moved to the release position and is maintained at the release position under the action of the resisting force of the power supply module 30, and then the ejector pin 12 does not interfere with the movement of the extension part 142 towards the 'on' position. At this point, the user may movably move the operating member 14 to the 'on' position; the extension part 142 of the operating member 14 drives the locking member 151 to move along the locking slot 117 towards the head end 1171 of the locking slot, through the limit part 1513; the two arm parts 1512 are also folded towards the intermediate part 1511 under the abutting/contacting of the locking slot 117, and fit the locking slot 117 to move, until the two arm parts 1512 are moved to the head end 1171 of the locking slot; the arm parts 1512 are not limited by the locking slot 1171 any more and are restored to the normal state under the action of their own elastic restoring force; at this point, each of the arm parts 1512 abuts against the head end 1171 under the action of the second elastic element 152; and as the arm parts 1512 and the limit part 1513 cooperated with each other limit the position of the extension part 142, the operating member 14 is also retained at the 'on' position. Moreover, when the user manually moves the operating member 14 to the 'on' position, the operating member 14 drives the locking member 151 to slide over the switch button 11352 to turn on the conducting wire 113.

After the adapter is dissembled from the power supply module 30, the ejector pin 12 is moved towards the blocking position under the action of the first elastic element 13. Due to the interference of the extension part 142, the ejector pin 12 will push the operating member 14 to move towards the 'off' position, and the extension part 142 of the operating member 14 abuts against the arm parts 1512 and pushes the arm parts 1512 to be folded, until the distance between the tail ends of the arm parts 1512 is less than the width of the locking slot 117; the locking member 151 will be pushed to run through the locking slot 117, until the two arm parts 1512 are moved to the tail end 1172 of the locking slot; the arm parts 1512 are not limited by the locking slot 117 any more and are restored to the normal state under the action of its own elastic restoring force; at this point, the arm parts 1512 abut against the tail end 1172 in such a way that it is difficult for the locking member 151 moving towards the head end 1171 of the locking slot; and meanwhile, the power supply mounting part 111 also abuts against the guide part 1514, so that the locking member 151 cannot be disengaged from the locking slot 117. At this point, the arm parts 1512 and the limit part 1513 may also be cooperated with each other to limit the position of the extension part 142, so the operating member 14 is retained/limited at the 'off' position again. Moreover, during the operating member 14 is moved towards the 'off' position, the operating member 14 drives the locking member 151 to reversely slide over the switch button 11352 to disconnect the conducting wire 113.

In actual application, in order to separate the arm parts 1512 from the head end 1171 and the tail end 1172 of the locking slot 117, the tail ends of the arm parts 1512 may be set to be chamfer angle or rounding-off.

The principle of the locking member 151 in turning on and turning off the conducting wire 113 is described in detail with reference to the structural definition of the locking member 151 in FIGS. 4 to 9:

The locking member 151 includes an inclined plane 1515 and a plane 1516 facing the 'on-off' switch 1135. The inclined plane 1515 and the plane 1516 may be disposed on a side of the intermediate part 1511 facing the 'on-off' switch 1135. When the operating member 14 drives the locking member 151 to move and be disposed at the 'off' position, the inclined plane 1515 of the locking member 151 is just disposed on the switch button 11352 of the 'on-off' switch 1135, and the switch button 11352 cannot be pressed towards the switch base 11351, so that the 'on-off' switch 1135 is switched off to disconnect the conducting wire 113. Conversely, when the operating member 14 drives the locking member 151 to move and be disposed at the 'off' position, the plane 1516 of the locking member 151 is just disposed on the switch button 11352 of the 'on-off' switch 1135, and the switch button 11352 can be pressed towards the switch base 11351, so that the 'on-off' switch 1135 is switched on to turn on the conducting wire 113. As the conducting wire 113 is turned on, the first conductive terminal 1131 and the second conductive terminal 1132 are electrically communicated, so that the power of the power supply module 30 can be transmitted to the light-emitting apparatus 20 through the conducting wire 113.

In the adapter 10, the light source device and the illuminating device 100, provided by the example of the present disclosure, by adoption of the ejector pin 12 and the operating member 14, which are matched with the power supply module 30, on the adapter 10, the ejector pin 12 may be moved to the blocking position for preventing the power supply mounting part 111 from being mounted on the power supply module 30 and the release position for releasing the power supply mounting part 111 to be mounted on the power supply module 30. When the adapter 10 is matched with the power supply module 30, the ejector pin 12 is moved to the release position under the action of the resisting force of the power supply module 30, and is maintained at the release position; and the movement of the operating member 14 and the locking with the outer wall 114 are that the operating member 14 drives the locking member 151 to slide over the switch button 11352 to turn on the conducting wire 113. When the adapter 10 is separated from the power supply module 30, the pressurized first elastic element 13 rebounds the ejector pin 12 from the release position to the blocking position. In this process, the operating member 14 is driven to move from the 'on' position to the 'off' position. Moreover, when the operating member 14 moves towards the 'off' position, the operating member 14 drives the locking member 151 to reversely slide over the switch button 11352 to disconnect the conducting wire 113, so as to avoid the electric shock caused by the starting of the illuminating device by a misoperation of the user, and hence the safety of the illuminating device is improved.

Alternatively or additionally, the main body has a longitudinal direction; and the operating member is operationally moved on the main body along the longitudinal direction.

Alternatively or additionally, the main body includes an outer wall and a sliding chute disposed on the outer wall and extended along the longitudinal direction; and the operating member is movably disposed in the sliding chute.

Alternatively or additionally, the ejector pin is operationally moved along the longitudinal direction.

Alternatively or additionally, the adapter further comprises a first elastic element disposed between the ejector pin and the main body; and when the ejector pin is at the release position, the first elastic element provides the ejector pin with an acting force for moving towards the blocking position.

Alternatively or additionally, when the power supply mounting part is separated from the power supply module, the pressurized first elastic element provides the ejector pin with an acting force for moving towards the blocking position, and rebounds the ejector pin from the release position to the blocking position; and the operating member is driven to move from the 'on' position to the 'off' position in this process.

Alternatively or additionally, the conducting wire includes an 'on-off' switch; and the operating member is cooperated with the 'on-off' switch to turn on and turn off the conducting wire.

Alternatively or additionally, when the operating member is at the 'on' position, the operating member is locked to the inner cavity; and when the operating member is at the 'off' position, the operating member is unlocked from the inner cavity.

Alternatively or additionally, the adapter includes a locking mechanism for connecting the operating member and the main body; the locking mechanism is disposed in the inner cavity and operationally moved in the inner cavity to the locked state or the unlocked state; when the locking mechanism is in the locked state, the operating member is locked to the inner cavity; and when the locking mechanism is in the unlocked state, the operating member is unlocked from the inner cavity.

Alternatively or additionally, the main body includes a locking slot disposed in the inner cavity; the locking slot includes a head end and a tail end which are opposite to each other; the locking mechanism includes a locking member; and the locking member is driven by the operating member to move in the locking slot and be limited at the head end and the tail end of the locking slot, so that the locking mechanism can be respectively in the locked state and the unlocked state.

Alternatively or additionally, the locking mechanism is in the locked state, the operating member turns on the conducting wire through the locking member; and when the locking mechanism is in the unlocked state, the operating member disconnects the conducting wire through the locking member.

Alternatively or additionally, the conducting wire includes an 'on-off' switch; the locking member includes an inclined plane and a plane facing the 'on-off' switch; when the locking mechanism is in the locked state, the plane of the locking member moves to the top of the 'on-off' switch and activates the 'on-off' switch, so as to turn on the conducting wire; and when the locking mechanism is in the unlocked state, the inclined plane of the locking member moves to the top of the 'on-off' switch and releases the 'on-off' switch, so as to disconnect the conducting wire.

Alternatively or additionally, the locking member includes an intermediate part and arm parts disposed on two sides of the intermediate part and intersected with the intermediate part; the arm parts are elastically connected with the intermediate part and operationally folded and expanded relative to the intermediate part; and the intermediate part may move in the locking slot, so that the arm parts can abut against the head end and the tail end.

Alternatively or additionally, the locking member includes a limit part connected with the intermediate part; and when the locking member is limited to the head end and the tail end of the locking slot, the operating member abuts against the limit part.

Alternatively or additionally, the operating member includes a toggle part movably connected with the outer wall of the main body and an extension part connected with the toggle part; and the extension part is extended to a position between the arm parts and the limit part, and operationally abuts against the arm parts, so as to drive the arm parts to be folded relative to the intermediate part.

Alternatively or additionally, when the locking mechanism is in the locked state and the unlocked state, both the arm parts of the locking member are expanded relative to the intermediate part; and when the locking mechanism switches between the locked state and the unlocked state, the arm parts are folded under the limit of the extension part and move along the locking slot.

Alternatively or additionally, the locking member includes a guide part connected with the intermediate part; the guide part and the limit part are respectively disposed on opposite sides of the arm parts; and the guide part moves along the locking slot along with the intermediate part.

Alternatively or additionally, the limit part and the guide part are parallel to each other and perpendicular to the intermediate part.

Alternatively or additionally, the locking mechanism includes a second elastic element disposed between the locking member and the main body; and the second elastic element provides the locking member with an acting force for moving towards the tail end of the locking slot.

Alternatively or additionally, the light-emitting apparatus is a long straight lamp tube.

Alternatively or additionally, the adapter and the light-emitting apparatus are integrally arranged.

Alternatively or additionally, the light-emitting apparatus is a long straight lamp tube.

Alternatively or additionally, the light-emitting apparatus and the adapter are integrally arranged; and the power supply module and the adapter are detachably matched, where the power supply module and the adapter may be attached together or be detached or separated by an external force.

According to the technical solution provided by the above examples of the present disclosure, an adapter is provided in the light source device and the illuminating device. By providing the ejector pin and the operating member for the adapter, the ejector pin may be moved to the blocking position for preventing the power supply mounting part from being mounted on the power supply module and the release position for releasing the power supply mounting part to be mounted on the power supply module; the operating member is operationally moved on the main body to the 'on' position and the 'off' position; when the adapter is matched with the power supply module, the ejector pin is moved to the release position under the action of the resisting force of the power supply module, and is maintained at the release position, and the adapter and the power supply module are electrically connected when the operating member is moved to the 'on' position; and when the adapter is separated from the power supply module, the ejector pin is moved from the release position to the blocking position, and meanwhile, drives the operating member to move from the 'on' position to the 'off' position, and the electrical connection between the adapter and the power supply module is cut off, so as to avoid the electric shock caused by the starting of the illuminating device due to a misoperation of a user, and hence the safety of the illuminating device can be improved.

The foregoing specific examples provide further detailed description to the objective, the technical proposals and the advantages of the present disclosure. It should be understood that the foregoing is only the specific examples of the present disclosure and not intended to limit the present disclosure. Any modification, equivalent replacement, improvement or the like made within the spirit and the principle of the present disclosure shall fall within the scope of protection of the present disclosure.

What is claimed is:

1. An adapter, used for electrically connecting a power supply module and a light-emitting apparatus, comprising:

a main body including:

an outer wall forming an inner cavity;

a power supply mounting part disposed on the outer wall and used for being matched with the power supply module;

a light source mounting part disposed on the outer wall, arranged oppositely to the power supply mounting part, and used for being matched with the light-emitting apparatus; and a conducting wire disposed in the inner cavity, and configured to be capable of being turned on and turned off, and used for transmitting electrical power outputted by the power supply module to the light-emitting apparatus when the power supply mounting part is matched with the power supply module and the light source mounting part is matched with the light-emitting apparatus;

an ejector pin movably connected to the main body, in which the ejector pin is operationally moved to a blocking position for preventing the power supply mounting part from being matched with the power supply module and a release position for releasing the power supply mounting part to be matched with the power supply module; and an operating member movably connected with the main body and the ejector pin, in which the operating member is operationally moved on the main body to an 'on' position and an 'off' position; when the operating member is at the 'on' position, the operating member is locked to the inner cavity; when the operating member is at the 'off' position, the operating member is unlocked from the inner cavity; when the power supply mounting part is matched with the power supply module, the ejector pin is moved to the release position under a resisting force of the power supply module and is maintained at the release position, and the operating member is moved to the 'on' position to turn on the conducting wire; and when the power supply mounting part is separated from the power supply module, the ejector pin is moved from the release position to the blocking position, and meanwhile, drives the operating member to move from the 'on' position to the 'off' position to disconnect the conducting wire.

2. The adapter according to claim 1, wherein the main body has a longitudinal direction; and the operating member is operationally moved on the main body along the longitudinal direction.

3. The adapter according to claim 2, wherein the main body includes a sliding chute disposed on the outer wall and extended along the longitudinal direction; and the operating member is movably disposed in the sliding chute.

4. The adapter according to claim 2, wherein the ejector pin is operationally moved along the longitudinal direction.

5. The adapter according to claim 1, wherein the adapter further comprises a first elastic element disposed between the ejector pin and the main body; and when the ejector pin is at the release position, the first elastic element provides the ejector pin with an acting force for moving towards the blocking position.

6. The adapter according to claim 5, wherein when the power supply mounting part is separated from the power supply module, the pressurized first elastic element provides the ejector pin with an acting force for moving towards the blocking position, and rebounds the ejector pin from the release position to the blocking position, and the operating member is driven to move from the 'on' position to the 'off' position in this process.

7. The adapter according to claim 1, wherein the conducting wire includes an 'on-off' switch; and the operating member is cooperated with the 'on-off' switch to turn on and turn off the conducting wire.

8. The adapter according to claim 1, the adapter includes a locking mechanism for connecting the operating member and the main body; the locking mechanism is disposed in the inner cavity and operationally moved to a locked state or an unlocked state in the inner cavity; when the locking mechanism is in the locked state, the operating member is locked to the inner cavity; and when the locking mechanism is in the unlocked state, the operating member is unlocked from the inner cavity.

9. The adapter according to claim 8, wherein the main body includes a locking slot disposed in the inner cavity; the locking slot includes a head end and a tail end which are opposite to each other; the locking mechanism includes a locking member; and the locking member is driven by the operating member to move in the locking slot and be retailed at the head end and the tail end of the locking slot, so that the locking mechanism can be respectively in the locked state and the unlocked state.

10. The adapter according to claim 9, wherein when the locking mechanism is in the locked state, the operating member turns on the conducting wire through the locking member; and when the locking mechanism is in the unlocked state, the operating member disconnects the conducting wire through the locking member.

11. The adapter according to claim 10, wherein the locking member includes an intermediate part and arm parts disposed on two sides of the intermediate part and intersected with the intermediate part; wherein the locking member includes a guide part connected with the intermediate part; the guide part and a limit part are respectively disposed on opposite sides of the arm parts; and the guide part moves along the locking slot along with the intermediate part.

12. The adapter according to claim 11, wherein the limit part and the guide part are parallel to each other and perpendicular to the intermediate part.

13. The adapter according to claim 9, wherein the locking mechanism includes a second elastic element disposed between the locking member and the main body; and the second elastic element provides the locking member with an acting force for moving towards the tail end of the locking slot.

14. A light source device, comprising:

a light-emitting apparatus; and an adapter comprising a light source mounting part that is matched with the light-emitting apparatus, wherein the adapter comprises:

a main body including:

an outer wall forming an inner cavity;

a power supply mounting part disposed on the outer wall and used for being matched with the power supply module;

a light source mounting part disposed on the outer wall, arranged oppositely to the power supply mounting part, and used for being matched with the light-emitting apparatus; and a conducting wire disposed in the inner cavity, and configured to be capable of being turned on and turned off, and used for transmitting electrical power outputted by the power supply module to the light-emitting apparatus when the power supply mounting part is matched with the power supply module and the light source mounting part is matched with the light-emitting apparatus, wherein the conducting wire is configured to be electrically connected with the light-emitting apparatus;

an ejector pin movably connected to the main body, in which the ejector pin is operationally moved to a blocking position for preventing the power supply mounting part from being matched with the power supply module and a release position for releasing the power supply mounting part to be matched with the power supply module; and an operating member movably connected with the main body and the ejector pin, in which the operating member is operationally moved on the main body to an 'on' position and an 'off' position; when the operating member is at the 'on' position, the operating member is locked to the inner cavity; when the operating member is at the 'off' position, the operating member is unlocked from the inner cavity; when the power supply mounting part is matched with the power supply module, the ejector pin is moved to the release position under a resisting force of the power supply module and is maintained at the release position, and the operating member is moved to the 'on' position to turn on the conducting wire; and when the power supply mounting part is separated from the power supply module, the ejector pin is moved from the release position to the blocking position, and meanwhile, drives the operating member to move from the 'on' position to the 'off' position to disconnect the conducting wire.

15. The light source device according to claim 14, wherein the light-emitting apparatus is a long straight lamp tube.

16. The light source device according to claim 14, wherein the adapter and the light-emitting apparatus are integrally arranged.

17. An illuminating device, comprising:

a light-emitting apparatus;

a power supply module; and an adapter comprising a light source mounting part that is matched with the light-emitting apparatus, wherein the adapter comprises:

a main body including:

an outer wall forming an inner cavity;

a power supply mounting part disposed on the outer wall and used for being matched with the power supply module, wherein the power supply mounting part in the adapter is matched with the power supply module;

a light source mounting part disposed on the outer wall, arranged oppositely to the power supply mounting part, and used for being matched with the light-emitting apparatus; and a conducting wire disposed in the inner cavity, and configured to be capable of being turned on and turned off, and used for transmitting electrical power outputted by the power supply module to the light-emitting apparatus when the power supply mounting part is matched with the power supply module and the light source mounting part is matched with the light-emitting apparatus, wherein the conducting wire is configured to be electrically connected with both the light-emitting apparatus and the power supply module;

an ejector pin movably connected to the main body, in which the ejector pin is operationally moved to a blocking position for preventing the power supply mounting part from being matched with the power supply module and a release position for releasing the power supply mounting part to be matched with the power supply module; and an operating member movably connected with the main body and the ejector pin, in which the operating member is operationally moved on the main body to an 'on' position and an 'off' position; when the operating member is at the 'on' position, the operating member is locked to the inner cavity; when the operating member is at the 'off' position, the operating member is unlocked from the inner cavity; when the power supply mounting part is matched with the power supply module, the ejector pin is moved to the release position under a resisting force of the power supply module and is maintained at the release position, and the operating member is moved to the 'on' position to turn on the conducting wire; and when the power supply mounting part is separated from the power supply module, the ejector pin is moved from the release position to the blocking position, and meanwhile, drives the operating member to move from the 'on' position to the 'off' position to disconnect the conducting wire.

18. The illuminating device according to claim 17, wherein the light-emitting apparatus is a long straight lamp tube.

19. The illuminating device according to claim 17, wherein the light-emitting apparatus and the adapter are integrally arranged; and the power supply module and the adapter are detachably matched.

* * * * *